US007074992B2

(12) United States Patent
Schmidt

(10) Patent No.: US 7,074,992 B2
(45) Date of Patent: Jul. 11, 2006

(54) SOUNDHOLE INSERT FOR A STRINGED INSTRUMENT

(76) Inventor: Eric T. Schmidt, 524 Commerce St., Wichita, KS (US) 67202

( * ) Notice: Subject to any disclaimer, the term of this patent is extended or adjusted under 35 U.S.C. 154(b) by 0 days.

(21) Appl. No.: 10/942,267

(22) Filed: Sep. 16, 2004

(65) Prior Publication Data

US 2006/0054001 A1 Mar. 16, 2006

(51) Int. Cl.
*G10D 3/02* (2006.01)

(52) U.S. Cl. ..... 84/294

(58) Field of Classification Search ..... 84/294, 84/453

See application file for complete search history.

(56) References Cited

U.S. PATENT DOCUMENTS

| | | | | |
|---|---|---|---|---|
| 4,024,788 | A | 5/1977 | Dunlap | |
| 4,632,003 | A * | 12/1986 | Kopp | 84/723 |
| 5,883,322 | A * | 3/1999 | Baker | 84/453 |
| 6,639,134 | B1 * | 10/2003 | Schmidt | 84/291 |

* cited by examiner

*Primary Examiner*—Kimberly Lockett
(74) *Attorney, Agent, or Firm*—Shook, Hardy & Bacon L.L.P.

(57) ABSTRACT

A unique shaped insert for the soundhole of an acoustic guitar has numerous embodiments. The insert is alternatively of two piece construction. In each embodiment, the invention has a forward portion that is used to secure the inside edge of the soundhole. It's attachment imparts a new and distinctive sound to the stringed instrument in which it is installed.

8 Claims, 3 Drawing Sheets

SOUNDHOLE INSERT FOR A STRINGED INSTRUMENT

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates generally to the field of stringed instruments. More specifically, the present invention is related to the field of improving the tonal characteristics of a guitar through soundhole modification.

2. Description of the Related Art

The typical acoustic guitar has a hollow body. The body defines a resonance chamber therein. The chamber is contained by a forward panel of the body. This panel is commonly referred to as a "sound board." The sound board includes a hole. This hole is referred to as the "sound hole." Connected to and extending back from the soundboard is a sideboard. This sideboard is completely closed off on its back edges by a backboard.

Typically all of these components of the conventional guitar are constructed of choice pieces of wood. Composites or other materials may be used instead, however.

The guitar also has a neck. One end of the neck is connected to the guitar body proximate the soundhole. The other end terminates in a headstock. On the headstock, one end of the strings are strung in a direction along the neck towards the body, and attached to a bridge. The bridge is fixed to the soundboard. It serves as an anchor for the other end of the strings. The bridge is placed such that the strings extend over the soundhole. The bridge typically includes a saddle. The saddle transfers vibrations in the strings to the soundboard. This results in the vibration of the entire soundboard.

The conventional soundhole is simply a circular cut out portion of the flat soundboard. When these strings vibrate above it, the bodily configuration of the guitar, including the resonance chamber cooperate with the soundhole to amplify the sound created by the vibrating soundboard.

It has been discovered that the sound of the guitar may be improved by constructing its soundboard, sideboard, and back of particular woods and/or composites. Various kinds and numbers of strings have been selected to alter its sound.

It is also known that the actual body design of the guitar affects its sound. It is immediately apparent upon examining the conventional guitar that it has a narrowed waist. One practical aspect of the narrowed waist is that it makes it easier to play for the user. This is because it is easily set upon the user's knee. However, this design also affects the sound. There are two widened areas in the resonance chamber which are called bouts. There is one bout where the neck connects, which is smaller. There is a second bout where the bridge attaches which is slightly larger. It is known in the art that the particular sizes and shapes of these bouts and their relativity to one another has much to do with the tone that the guitar produces. Thus, manipulation of the bouts and their shapes will cause a guitar to sound different. It has been discovered that the size of the lower bout—when optimized—accentuates the tones in the lower register of the instrument. And it is also known that ideal configuration of the upper bout accentuates the tones in the higher register when the instrument is played.

It has also been known in the art to reshape soundholes to affect sound. One example of this is U.S. Pat. No. 6,639,134 issued to Schmidt.

It has also been known to use soundhole inserts to change the volume of stringed instruments. U.S. Pat. No. 4,024,788 issued to Dunlap discloses various plastic foam inserts. These inserts are used to completely occlude the soundholes of either guitars or violins. The purpose of the insert is to mute the instrument. This enables the musician to practice without distracting others in the near vicinity.

SUMMARY OF THE INVENTION

The present invention, in some embodiments, provides a soundhole insert for installation in a soundhole of a guitar, or other stringed instrument. Once inserted, the device changes and improves sound quality.

These embodiments include a first portion which is adapted to receive at least a portion of said soundboard of the guitar. In most instances, the edge of the soundhole. The embodiments also include a second portion. This second portion reforms said edge for the purpose of changing an acoustical characteristic of the instrument. One embodiment of the insert reforms the edge into a double-flared flange. Another embodiment includes a substantially cylindrical flange.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The present invention provides a device and method for improving the tonal characteristics of a stringed instrument. Among those tonal characteristics positively affected are resonance quality and volume.

During play, a guitar's resonance chamber directly receives some of the sound waves created by the vibrating strings immediately outside it through the soundhole. For these soundwaves, the resonance chamber defines an encapsulating barrier. This barrier, defined by the internal surfaces of the chamber, isolates certain wavelengths of sound waves. It then expels them back out through the soundhole in a resonating fashion in unison with the strings.

The device of the present invention improves the tone quality, and even increases the volume level of the musical instrument. This is accomplished through a compounding of sound waves projected from the vibrating strings to the resonating chamber which is coupled with the soundhole.

Figure 8:
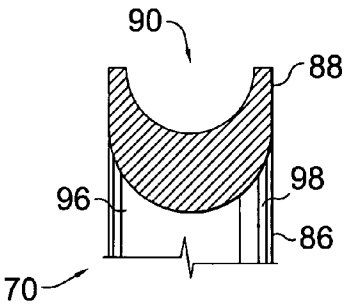
FIG. 8 discloses a cross sectional view of the soundhole insert of the second embodiment.
Figure 9:
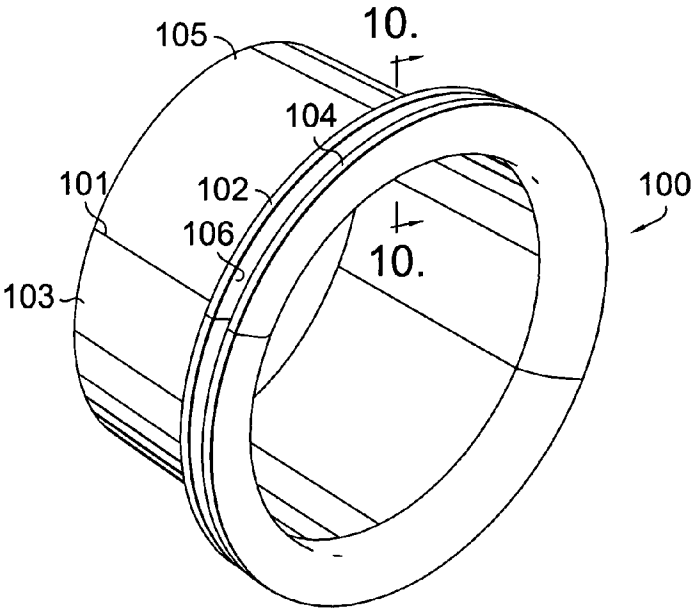
FIG. 9 shows a third embodiment of the soundhole insert of the present invention as it would appear before installation in the guitar.
Figure 10:
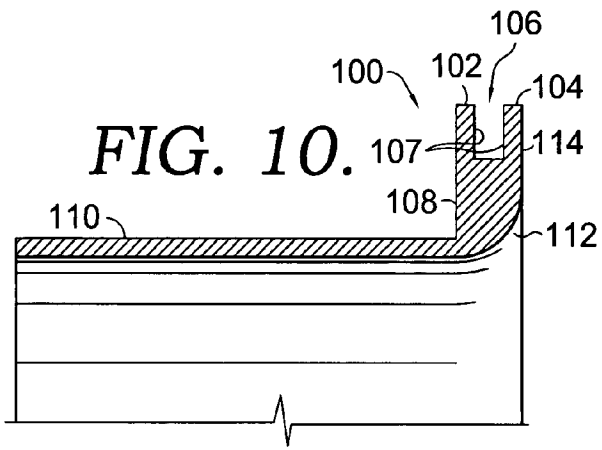
FIG. 10 shows a cross sectional view of the insert of the third embodiment.

A first embodiment of the present invention comprises a two-piece insert which is shown in FIGS. 1–4 and 6. A second embodiment is shown in FIGS. 7 and 8. A third embodiment is shown in FIGS. 9 and 10.

Each of the three embodiments have much in common. Each has flanges that extend into the resonance chamber of the stringed instrument from the edge (or lip) of the soundhole. Normally, the flange will be a single circular flange. In the case the soundhole of the stringed instrument is not circular, however, each of the three embodiments could be easily reconfigured to be receivable onto the shape of the irregularly-shaped soundhole edge. The preferred embodiments, however, have been adapted for circular soundholes simply because these soundholes are most prevalent.

In the first two embodiments, the flange is flared inward from the edge of the soundhole. This flared configuration causes the soundhole to act on the resonating sounds in similar nature and operation to that of a bell or flared trumpet horn end. This creates an expanded fluted range for the sound waves exiting the resonance chamber through the sound hole. The sound output has better quality and increased volume.

In a third embodiment, the flange does not flare, instead is substantially normal to the plane in which the soundboard lies. This particular embodiment also increases volume and creates new tonal qualities different from those of a conventional guitar.

The structural details and installation techniques for each of the three embodiments will now be discussed. Referring to the first embodiment of FIGS. 1–6, FIG. 1 discloses a guitar 10 with a first embodiment of the present invention already installed therein. This guitar is conventional in nature, and thus includes a body 12. Body 12 defines a resonance chamber therein (not pictured). Fixed to the body at one end is a neck 14. This neck is fixed at its proximate end to the body 12. At its other distal end, neck 14 has a head stock 24. Head stock 24 secures one end of the strings 15. The other end of the strings 15 are secured to a bridge which is fixed on the body 12. More specifically, the bridge 22 is fixed to the front planar soundboard 16 of the guitar. The guitar also has a side member 20 which extends all around the periphery of sound board 16. It extends backward to meet up with a back (not pictured) which along with side member 20 and sound board 16 completes the resonance chamber including body. The visible portion of the insert 30 of the first embodiment of the present invention may be seen in the figure.

Figure 1:
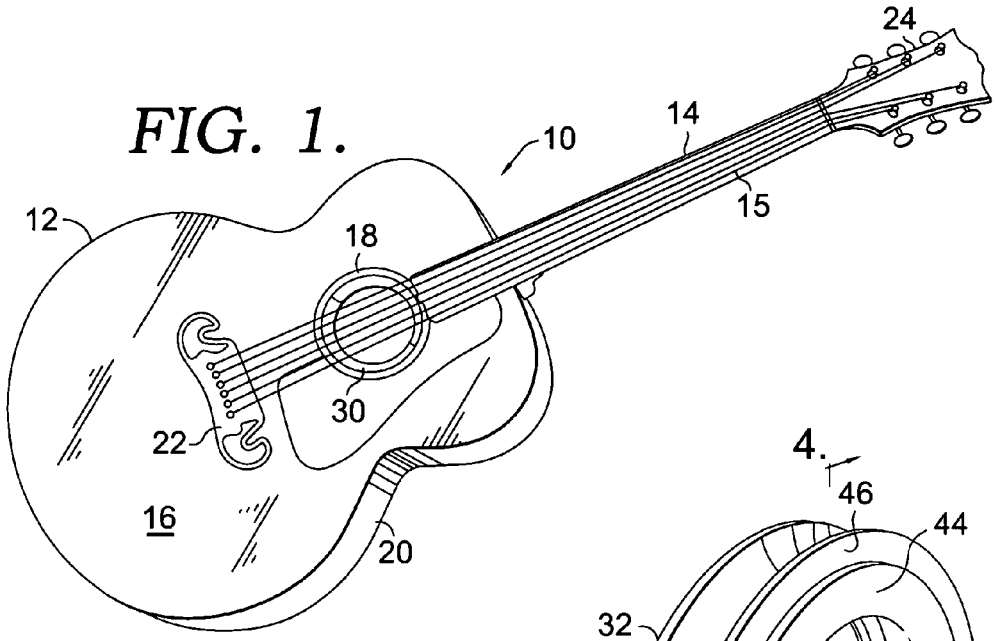
FIG. 1 is a perspective view of a guitar in which an insert of the first embodiment of the present invention has been installed.
Figure 2:
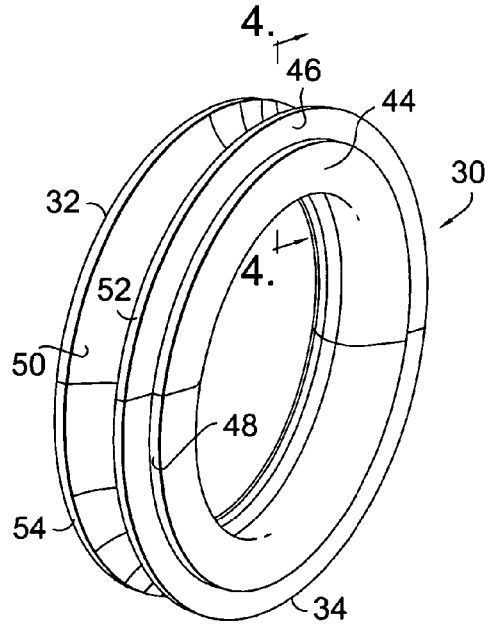
FIG. 2 is a perspective view of the insert of the first embodiment of the present invention with the ends of each of it's two pieces brought together as would be the case after installation in the guitar.

More specifics regarding insert 30 are shown in FIG. 2. Referring to this figure, we see that insert 30 comprises a first portion 32 and a second portion 34. In this figure, the portions 32 and 34 are shown being connected. This is the joined condition they will be in after they have been installed in the guitar. For example, as in FIG. 1.

Figure 3:
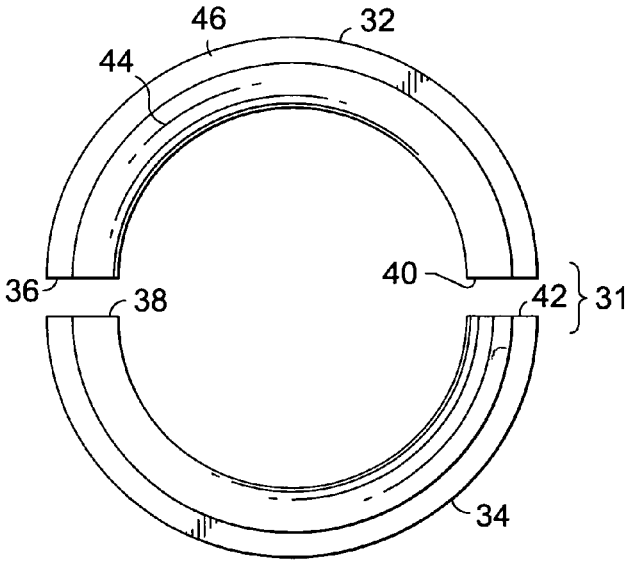
FIG. 3 is a front view of the insert of the first embodiment of the present invention it's two pieces separated as would be the case before installation.

Before installation, however, halves 32 and 34 are separate and appear as shown in FIG. 3. A gap of separation 31 has been provided in the figure to show this separateness. Referring now back to FIG. 2, we see that the first embodiment 30 has a tiered construction. It's first and second portions, 32 and 34 respectively, have mating ends which will ultimately be adhered together. First portion 32 has a first mating end 36. Likewise, second portion 34 has a first mating end 38. These two ends are glued or otherwise adhered together as part of the installation process. First portion 32 also has a second mating end 40 which reciprocates with a second mating end 42 on the second portion 34 upon installation.

After being installed, the only part observable on the guitar is an exposed surface 44. This is the surface actually visible in FIG. 1. The rest of the device is concealed within or underneath soundboard 16 of the guitar 10 body 12. Because of this, the appearance of the guitar is not significantly visually different than that of a standard guitar. Thus, aesthetics are not greatly impacted.

Figure 4:
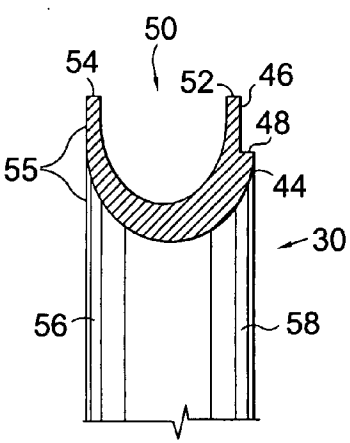
FIG. 4 shows a cross section taken at section 4—4 in FIG. 2 showing a profile of the attachment features of the insert of the first embodiment of the present invention.

Considering the device in cross section, as revealed in FIG. 4, immediately behind forward exposed surface 44 on the device is a shelf 46. Shelf 46, upon installation, will receive the underside of an inner edge of the soundhole. Shelf 46 is displaced from exposed surface 44 by an abutment wall 48. Abutment wall 48 abuts an inside edge of the soundhole once installed. Evident from both FIGS. 2 and 4 is that behind exposed surface 44 and shelf 46, a front ridge 52 drops off into a radial channel 50. Radial channel 50 then rises again to plateau at a back ridge 54. An innermost planar face 55 is only evident in FIG. 4. This face extends all the way around insert 30. This completes the description of the radially-outer-most features of insert 30.

With respect to the radially-inward features of the device, the exposed surface 44 comprises the forwardmost portion of an outward flare 58. Cross sectionally, outward flare 58 curves downward, around, and then back up again in an inward flare 56.

Figure 6:
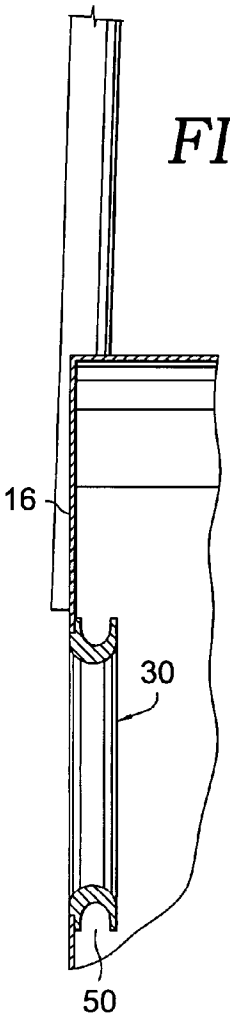
FIG. 6 shows the cross section of the guitar shown in FIG. 5 after the insert of the first embodiment of the present invention has been installed.
Figure 5:
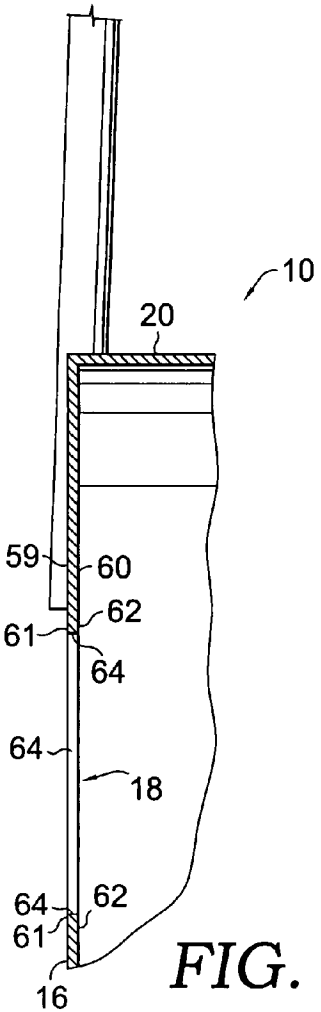
FIG. 5 shows a cross sectional view of a guitar body of a guitar before the installation of the inserts of the embodiments of the present invention are installed.
Figure 7:
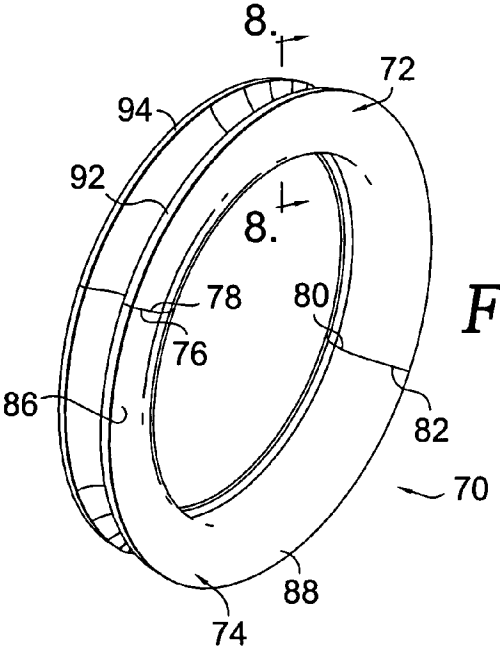
FIG. 7 shows a perspective view of the insert of the second embodiment of the present invention with its two pieces abutted together as it would be installed on the under side of the soundboard of a guitar.

FIGS. 5 and 6 show how the insert 30 is installed in the soundhole 18 of the guitar. FIG. 5 shows the guitar body 20 as it appears before installation of the device. Circular soundhole 16, which is centered and cut through soundboard 18 of the guitar, has an inside edge 61. Also shown in the figure is that a top surface 59 of the sound board and an under side surface 60. Installation involves adherence of the abutment wall 48 and shelf 46 of the insert to a surface 62. Surface 62 is on the underside of the soundboard nearest the soundhole. Soundhole 18 also defines an inside surface 64 at the soundhole's edge 61.

The insert 30 is, as shown in the figures, broken into two portions in order that it might be installed in already assembled/manufactured guitars. With already assembled guitars, the only opening into the resonance chamber is through the soundhole, because the body closes off everywhere else. If the insert 30 were an integral unit rather than being presented in separate portions 32 and 34, it would not fit through the soundhole 18. Thus, this restriction is defeated, in this embodiment, by splitting the insert 30 in two.

The installation process for first embodiment 30 occurs one portion at a time. Initially, only one of portions 32 and 34 will be adhered. This is necessary because the Assuming selection of portion 32 as the first to be installed, the strings of the guitar should first be removed. In some cases string removal may not be required. But usually it will make the process easier. Next, an adhesive, such as a wood glue, is applied to the abutment wall 48 and shelf 46 on selected portion 32. Once the adhesive has been applied, and is ready for adhesion, portion 32 should be inserted through soundhole 18 so that it is proximate surface 62, said proximate surface 62 being on the under side of the sound board 60 nearest the soundhole edge 61. The insert half 32 should be held by the installer exposed surface up, then brought up so that adhesive-coated surfaces 46 and 48 adhere to the soundhole edge 61. The abutment surface 48 of the insert adheres to an inside surface 64 of the soundhole 18. The shelf 46 adheres to the proximate surface 62 which is on the soundboard's underside nearest the hole.

The kind of adhesive most apt for the above process depends on the material selected to construct the insert. In the preferred embodiment, insert 30 is constructed of wood. It could, however, be constructed of some composite material, plastic, or any other material and still fall within the scope of the invention. The kind of material used to construct insert 30 may have some bearing on the particular means of adhering used, but in the preferred wooden embodiment, simple wood glue or another wood compliant adhesive should be applied to abutment wall 48 and shell 46 in first portion 32.

Once first portion 32 is installed, second portion 34 is able to be installed thereafter. This is done by coating the same surfaces with adhesives as was done for the first portion 32, and then lowering the portion into the hole and mating it up with the portion 62 and surface 64 just like with the first portion. Once this is done, end 36 of first portion 32 will be mated with end 38 of second portion 34. Likewise, end 40 of first portion 32 will meet up with portions 34 and 42. It is also probably beneficial to apply adhesive to these ends in order to make the adherence of device 30 optimal.

Once both portions 32 and 34 have been installed, the cross sectional appearance will be as shown in FIG. 6. The figure shows the after-installation appearance of wall 48 and shell 46 being adhered to inside surface 64 of hole edge 61 and under side portion 62 nearest the soundhole. This installed insert 30 is flared into the interior of the guitar resonance chamber, and also flared out of the resonance chamber. This double-flared configuration improves the sound quality and increases the sound volume.

Though a specific configuration and method of installation have been disclosed above regarding first embodiment 30, it should be recognized that numerous variations exist which would still fall within the scope of the invention.

For example, the installation process for insert 30 would likely be completely different if it was installed on soundboard before the guitar was completely assembled by the manufacturer. In such a case, there would be no need for the two-piece construction shown. Instead, insert 30 would have ends 36 and 38 and ends 40 and 42 already glued together before being adhered to the soundhole. Even more likely is that insert 30 would be manufactured as an integral unit without separate portions (e.g. 32 and 34). This is because, before the body of the guitar is completed by assembling soundboard 16, sideboard 20, and it's back, there would still be access to the underside of the soundboard without having to take the insert 30 through the size-restricting soundhole 18. Thus, insert 30 could be either manufactured as an integral unit or made integral pre-installation because it could be fixed to the edge and underside of the soundhole before the soundboard was assembled on the guitar body.

It is important to note, that numerous other embodiments incorporating some or all of the above-disclosed principles are possible. For example, a second embodiment of the present invention 70 is shown in FIGS. 7 and 8. Insert 70 of the second embodiment, after installation, is much like that of the insert 30 of the first embodiment. Its sound enhancing properties are much the same because of its similar double-flared configuration. Also like the first embodiment, insert 70 comprises two parts. It has a first portion 72 and a second portion 74. Another similarity to the first embodiment 30 is that insert 70 has mateable ends. A first mating end 76 and a second mating end 80 exist on first portion 72 and serve to later be adhered to a first mating end 78 and a second mating end 82 on second portion 74.

Considering in cross section the insert when portions 72 and 74 have been adhered to one another to create an integral unit (either before or after installation), reveals that an upper surface 86 has an outer edge 88 thereon which is substantially planar. This outer edge 88 of planar surface 86 is what is used to bond the insert 70 to the underside of the soundboard nearest the soundhole.

The outermost regions of insert 70 comprise a radial channel 90. Radial channel 90 is defined between a front ridge 92 and a back ridge 94. Like with the first embodiment, insert 70 when installed will create an inward flare 96 and an outward flare 98. These features make insert 70 perform similarly, tonally speaking, to insert 30.

The installation process for insert 70 is different than that for the first embodiment. Instead of its placement being controlled by an abutment and shelf arrangement, it is simply centered underneath the under side of the soundhole 18 and glued. Because does not have self-aligning features like the first embodiment, it will require some lining up. More specifically, the installer must line up the center axis of the soundhole with the center axis for the insert 70. Insert 70 should be sized such that this is possible and also such that the insert has dimensions making it slightly radially larger than the soundhole radius. Thus, the installer can simply line up the profile of the insert so that it matches the sound hole edge 61.

Like with the first embodiment, the installation technique used for insert 70 will likely depend on whether the guitar has already been assembled or not. If the guitar has already been assembled, it will be necessary to install one portion of the insert at a time. The installer should select one of the two halves, e.g., first portion 72. This portion 72 will then be glued underneath the under side edge of the soundhole.

Prior to insertion, the guitars strings should be removed, adhesive placed on the substantially planar outer edge 88 of upper surface 86, and the insert lowered though the soundhole slightly. With edge 88 of the insert facing up, the portion 72 is pressed up so that the adhesive coated edge 88 meshes with surface 62—the part of the underside of the soundboard nearest the soundhole. Again, this half should be oriented so that its center axis is equal to the center axis of the soundhole. This may be done by observing the position of outward flare 98 through the hole. Once this first portion 72 has been adhered to the under side surface 62 of the guitar soundhole, second portion 74 may be lowered in through the soundhole and its ends 78 and 82 mated with ends 76 and 80 of the first portion 72. It is also advisable, though not absolutely necessary, to put adhesive on the ends so that the overall insert 70 is more stable.

If installed before the guitar is assembled in the factory (or elsewhere) insert 70, like with the first embodiment, could be manufactured and maintained as an integral unit instead of having separate portions 72 and 74. Alternatively, even if ends manufactured in dual portion configuration, the insert could be preassembled at its ends 76, 78, 80 and 82 prior to being adhered to the back of the under side of the sound board.

A third embodiment of the present invention is shown in FIGS. 9 and 10. As can be seen in these figures, a third-version insert 100 has a two-piece design divided at a separable split 101.

As may be seen from cross sectional FIG. 10, third insert 100 comprises an inner ridge 102 and an outer ridge 104 which together define a receiving channel 106. This receiving channel 106 will be used to receive the edge 61 of the soundhole 18 when it is installed. These features are all included on a flange 108 of the insert.

At the forwardmost part of insert 100 is a horizontal front face 114. Face 114 internally recedes into a slight outward flare portion 112. In contrast to the earlier embodiments, however, the extension of a flange 110 into the resonance chamber of the guitar occurs in a direction substantially normal to the planar surface of sound board 16. This substantially perpendicular flange 110 (substantially perpendicular when viewed in cross-sectional FIG. 10, substantially cylindrical when viewed in perspective view FIG. 9) extends into the resonance chamber.

It, like the first two embodiments, changes the sound tone and volume of the guitar. The change created, however, is different than that created in the first two embodiments. Sound quality is in many respects a very subjective property. Thus, in the interest of satisfying different tastes, the sound created by this cylindrically extending insert 100 provides an alternative kind of sound while at the same time slightly increasing volume.

The installation process for this third embodiment is also different. One difference is that the insert is essentially snapped onto the inner edge 61 of the soundhole. This may be done by adhering a first portion 103 of the insert into the soundhole. Then later, installing a second portion 105.

More specifically, this one-half-at-a-time method involves optionally applying adhesive into the receiving channel 106 of portion selected (e.g., portion 103). Adhesive will probably also be applied to a pair of opposing faces 107 inside each of ridges 102 and 104. Further, adhesive will likely be applied to the ends of the portion existent at the split 101. This will more securely hold the two portions together after installation.

After the first portion, e.g., 103 is installed, the second portion 105 is lowered into the hole and installed the same way as the first half. Second portion 105's ends are adhered to the ends of portion 103 where the two were earlier split from one another at 101.

The result, it an installed third-embodiment insert which has a substantially cylindrical flange which extends into the resonance chamber of the guitar.

Like with the first two embodiments, if installed premanufacture, the insert could be created as an integral unit.

Another alternative installation procedure is possible with the third embodiment. With this technique, Here, however, the edge of the soundhole 61 is snapped into the receiving channel 106 on each half of the device, each of which is glued in one at a time.

An alternative method of installation, however, could also be here as well. This would be done by forming the entire insert 100 integrally and of a material which at least slightly plyable, like a hard plastic or other material. In such a case, the insert could be inserted into the soundhole of an already assembled guitar (strings removed) and snapped over the edge 61 of the soundhole. To do this, substantially normal inwardly extending portion 110 of insert 100 would be inserted into the soundhole down into the resonance chamber of the guitar until the outer surface of the soundhole engaged inner ridge 102. The radius of inner ridge 102 would have to be sized and manufactured of material such that it would flex to allow soundhole edge 61 to snap into receiving channel 106. Depending on the plyability of insert 100, this may take some wrangling. For example, only a portion of inner ridge 102 may be lapped over the soundhole edge a little at a time.

Another way to accomplish this might involve reshaping the profile of inner ridge 102 such that it more easily passes over the soundhole edge 61 so that the insert 100 is more easily installed. This might be done by rounding its edges. It could also be done by angling the ridge upward (not shown). The upward slope created would enable the edge 61 to pass up it and then snap in place inside the channel 106. The interior face 107 would then prevent its removal.

Ultimately, the entire soundhole edge 61 should be completely snapped into receiving channel 106. Adhesive could be used on all or some of the inner surfaces of receiving channel 106, but is not necessary with this embodiment. This version, unlike the others, is more easily removable and reinsertable by the user. It may be taken in and out at the discretion of the user.

It will be noticed that this third embodiment, because of its substantially normal cross sectional flange shape, is much different from the flared, arcuate designs of the first and second embodiments. It is important to note also that numerous other flange configurations could be used which would fall within the scope of the present invention, and that a particular configuration should not be included as a limitation unless expressly done so in the claims.

Each of the three embodiments disclosed has different installation-related features. These are the features used to secure the device to the soundhole, e.g., the abutment surface/shelf design of the first embodiment, the bonded upper surface of the second embodiment, and snap-in design of the third embodiment. It is important to note that each of these installation systems is interchangeable with a different kind of flange design. E.g., the attachment systems of the first and second embodiments could be used with a substantially cylindrical flange design. Further, the snap-in system of the third embodiment could be coupled with a double flared flange design.

The easy removal and reinstallation of the third embodiment, and numerous other possible embodiments, makes the insert of the present invention ideal if a user desires to immediately adjust the tonal quality of a guitar. It is easily changed in and out. This interchangeability enables the user to quickly tonally alter the guitar's sound by selecting a particular insert. The user could add one of the double-flared-flange embodiments to his or her guitar to achieve one type of unconventional tonal qualities. Thereafter, the user could add a substantially-cylindrical flange to create still another kind of tonal quality to the same guitar. Thus, it is also within the scope of this invention that multiple inserts, each being interchangeable on the same guitar, could be used to provide the user with a multiplicity of different sounds depending on which insert was installed.

As can be seen, the present invention and its equivalents are well-adapted to provide a new and useful methods and devices for creating different tonal characteristics for a stringed instrument. Many different arrangements of the various components depicted, as well as components not shown, are possible without departing from the spirit and scope of the present invention.

The present invention has been described in relation to particular embodiments, which are intended in all respects to be illustrative rather than restrictive. Alternative embodiments will become apparent to those skilled in the art that do not depart from its scope. Many alternative embodiments exist but are not included because of the nature of this invention. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out order described.

The invention claimed is:

1. A device for use in the soundhole of a stringed instrument, said stringed instrument including a resonance chamber and a soundboard, an edge of said soundboard defining said soundhole, said device comprising:

an upper receiving area, said receiving area being pliable such that it is adapted to receive at least a portion of said soundboard so that said device is able to be secured inside said soundhole by snapping it onto said edge of said soundboard between a first ridge and a second ridge; and a downwardly depending portion which reforms said edge for the purpose of changing an acoustical characteristic of the instrument and defines a passageway to said resonance chamber, said downwardly depending portion being one of arcuate and cylindricai and said portion defining a passageway to said resonance chamber.

2. The device of claim 1 wherein said downwardly depending portion comprises:

a cross section which is substantially perpendicular to the soundboard.

3. The device of claim 1 wherein said downwardly depending portion extends into said resonance chamber from said edge.

4. The device of claim 1 wherein said downwardly depending portion reforms said edge such that it extends down into the resonance chamber when installed.

5. A device for use in the soundhole of a stringed instrument, said stringed instrument including a resonance chamber and a soundboard, an edge of said soundboard defining said soundhole, said device comprising:

an upper receiving area adapted to receive at least a portion of said soundboard so that said device can be secured inside said soundhole; and a downwardly depending portion which reforms said edge for the purpose of changing an acoustical characteristic of the instrument and defines a passageway to said resonance chamber, and said downwardly depending portion reforms said edge such that it extends down and flares into the resonance chamber when installed;

a first part of said device and a second part of said device, said first and second parts being separable one from the other;

said first part being insertable through said soundhole such that it may be adhered to a first area along said edge;

said second part being insertable through said soundhole such that it may be adhered to a second area along said edge; and said first and second parts are adapted to cause the entire soundhole edge to be reformed when said parts are installed.

6. The device of claim 5 wherein said downwardly depending portion includes a lower flange which flares into the resonance chamber, and an upper flange which flares out of the soundhole.

7. The device of claim 5 wherein said downwardly depending portion comprises a flange having an arcuate cross section.

8. The device of claim 5 wherein said downwardly depending portion comprises a flange.

* * * * *

UNITED STATES PATENT AND TRADEMARK OFFICE

CERTIFICATE OF CORRECTION

PATENT NO. : 7,074,992 B2
APPLICATION NO. : 10/942267
DATED : July 11, 2006
INVENTOR(S) : Eric T. Schmidt It is certified that error appears in the above-identified patent and that said Letters Patent is hereby corrected as shown below:

Column 9, line 32 replace “cylindricai” with --cylindrical--

Signed and Sealed this

Twenty-seventh Day of March, 2007

JON W. DUDAS
*Director of the United States Patent and Trademark Office*